US011296418B2

(12) United States Patent
Zhang et al.

(10) Patent No.: US 11,296,418 B2
(45) Date of Patent: Apr. 5, 2022

(54) LOW-PROFILE DUAL-POLARIZATION FILTERING MAGNETO-ELECTRIC DIPOLE ANTENNA

(71) Applicant: SOUTH CHINA UNIVERSITY OF TECHNOLOGY, Guangdong (CN)

(72) Inventors: Xiuyin Zhang, Guangzhou (CN); Shengjie Yang, Guangzhou (CN); Zhijie Zhang, Guangzhou (CN); Yongmei Pan, Guangzhou (CN); Yunfei Cao, Guangzhou (CN); Yao Zhang, Guangzhou (CN)

(73) Assignee: SOUTH CHINA UNIVERSITY OF TECHNOLOGY, Guangdong (CN)

( * ) Notice: Subject to any disclaimer, the term of this patent is extended or adjusted under 35 U.S.C. 154(b) by 46 days.

(21) Appl. No.: 17/046,315

(22) PCT Filed: Oct. 25, 2019

(86) PCT No.: PCT/CN2019/113146

§ 371 (c)(1),
(2) Date: Oct. 9, 2020

(87) PCT Pub. No.: WO2020/177341

PCT Pub. Date: Sep. 10, 2020

(65) Prior Publication Data

US 2021/0151890 A1 May 20, 2021

(30) Foreign Application Priority Data

Mar. 1, 2019 (CN) ..... 201910153863.5

(51) Int. Cl.

| | |
|---|---|
| ***H01Q 9/16*** | (2006.01) |
| ***H01Q 1/38*** | (2006.01) |
| ***H01Q 1/50*** | (2006.01) |

(52) U.S. Cl.
CPC ..... *H01Q 9/16* (2013.01); *H01Q 1/38* (2013.01); *H01Q 1/50* (2013.01)

(58) Field of Classification Search
CPC ..... H01Q 9/16; H01Q 1/38; H01Q 1/50
(Continued)

(56) References Cited

U.S. PATENT DOCUMENTS

2019/0020110 A1* 1/2019 Paulotto ..... H01Q 19/005

FOREIGN PATENT DOCUMENTS

| | | |
|---|---|---|
| CN | 110233341 | 10/2016 |
| CN | 201711344181 | 6/2018 |

(Continued)

*Primary Examiner* — Andrea Lindgren Baltzell
(74) *Attorney, Agent, or Firm* — JMB Davis Ben-David

(57) ABSTRACT

The invention discloses a dual-polarized filtering magneto-electric dipole antenna, which comprises an upper dielectric substrate and a lower dielectric substrate. The upper surface of the upper dielectric substrate is printed with a radiator structure, and the lower dielectric substrate is printed with a slot coupling feed network; the radiator structure comprises four parasitic patches loaded with symmetrical slots. The parasitic patches are loaded with short-circuit probes, and the slot coupling feed network comprises two orthogonal sets of Y-shaped feeders and cross-shaped slots, and the cross-shaped slots are printed on a metal floor. The new parasitic slot structures on the radiator structure increases the bandwidth while introducing a high roll-off band edge filtering effect, and combined with the slot coupling feed network with filtering function to achieve good band-pass filtering characteristics and hardly introduce additional insertion loss.

5 Claims, 4 Drawing Sheets

(58) Field of Classification Search
USPC ..... 343/793
See application file for complete search history.

(56) References Cited

FOREIGN PATENT DOCUMENTS

| | | |
|---|---|---|
| CN | 201810281647 | 7/2018 |
| CN | 201811376850 | 2/2019 |
| CN | 201910153863 | 6/2019 |
| CN | 110364818 | 10/2019 |
| CN | 110401026 | 11/2019 |
| CN | 110534890 | 12/2019 |
| CN | 110544819 | 12/2019 |

* cited by examiner

LOW-PROFILE DUAL-POLARIZATION FILTERING MAGNETO-ELECTRIC DIPOLE ANTENNA

CROSS-REFERENCE TO RELATED APPLICATIONS

This is the U.S. National Stage of International Patent Application No. PCT/CN2019/113146 filed on Oct. 25, 2019, which in turn claims the benefit of Chinese Patent Application No. 201910153863.5 filed on Mar. 1, 2019.

TECHNICAL FIELD

The invention relates to the field of radio frequency communication, and in particular to a low-profile dual-polarization filtering magneto-electric dipole antenna.

TECHNICAL BACKGROUND

In recent years, the rapid development of modern wireless communication systems requires low-profile antennas to have high performance. Multi-band base stations are necessary for mobile communications and have high requirements for mobile communications. The strong mutual coupling between antenna units results in a sharp degradation of radiation patterns. To solve this problem, there are many typical methods, such as connecting a duplexer to a full-band antenna array, or using a decoupling network between different array units to enhance port-to-port isolation. However, the additional units required by these methods inevitably increase the complexity of the feed network and introduce additional insertion losses. Recently, filtering antenna units have been used to suppress mutual coupling between units operating in different frequency bands. When the out-of-band radiation of the filtering antenna unit is also suppressed, no additional duplexer and decoupling network are needed. In 2006, Wong and Luk invented a new complementary antenna, called a magneto-electric dipole, which combines a short patch antenna and an electric dipole. This antenna has the advantages of wide bandwidth, high directivity, low cross-polarization, and low back lobe radiation. However, due to the larger thickness of the magneto-electric dipole, about 0.254 it is inconvenient to use in many applications.

In recent years, the design of filtering antennas can be roughly divided into the following types. The first design is a collaborative design of filter and antenna feed portion or a simple cascade of filter and traditional antenna through an impedance transformer. The second design provides slots and holes on patch antenna or adds a metal probe to make the radiator itself having filtering characteristics. The third design is to add a non-radiative parasitic structure to make the radiation of the antenna produce a filtering effect.

A low-profile dipole antenna in the prior art is realized by using two orthogonal H-shaped feed lines and a laminated patch. The antenna has a lower profile, only 0.09 wavelength, but with a narrow bandwidth, at only 11%. There is also a low-profile dipole antenna that comprises four square radiation patches etched with U-shaped and square slots, four rectangular metal short walls, two crossed r-shaped feed lines, and a box-shaped reflector. The structure is relatively complex and difficult to implement miniaturization thereof.

In the existing dual-polarized filtering dipole antenna design, it is necessary to consider how to extend the bandwidth, reduce the height, and realize the passband edge having fast roll-off frequency selectivity and a certain out-of-band suppression capability. In addition, high polarization isolation is required between the two ports of the dual-polarized antenna unit, and that the antenna unit is miniaturized.

SUMMARY OF THE INVENTION

In order to overcome the disadvantages and shortcomings of the prior art antennas, the present invention provides a low-profile dual-polarization filtering magneto-electric dipole antenna. The radiation characteristics of the antenna can achieve high roll-off filtering characteristics and high polarization isolation. In addition, it can ensure no introduction of additional insertion loss and occupied area caused by redundant structures, and can expand the bandwidth and reduce the height.

The present invention excites a radiator structure with a low profile and a highly selective filtering response by using a slot coupling feed network with a fusion filtering function, and generates good broadband radiation characteristics and a high roll-off band-pass filtering effect.

The present invention adopts the following technical solutions:

A low-profile dual-polarized filtering magneto-electric dipole antenna, characterized in that, comprising an upper dielectric substrate and a lower dielectric substrate, a radiator structure is printed on an upper surface of the upper dielectric substrate, and a slot coupling feed network structure is printed on the lower dielectric substrate.

The radiator structure comprises four parasitic patches loaded with symmetrical slots, and the parasitic patches are loaded with short-circuit probes;

The slot coupling feed network structure comprises two orthogonal sets of Y-shaped feed lines and cross-shaped slots, the cross-shaped slots are printed on a metal floor, the metal floor and the Y-shaped feed lines are printed on a different surface of the lower dielectric substrate, the parasitic patches are connected to the metal floor through the short-circuit probes.

Each Y-shaped feed lines comprises a one-to-two power divider, and an output end of the one-to-two power divider is connected to two microstrip lines, the two microstrip lines extend after passing the cross-shaped slot, and the extended portion is bent, and coupled with the parasitic patch of the upper dielectric substrate through the cross-shaped slot to introduce a radiation suppression null.

A length of the extended portion is half an equivalent wavelength of a frequency at a position of the radiation suppression null.

The symmetrical slots comprise symmetrical rectangular slots with respect to a diagonal of the parasitic patches.

The invention also comprises two through-holes and an air bridge formed by a strip line, arranged at an intersecting position of the two sets of Y-shaped feed lines.

The beneficial effects of the present invention:

(1) The dipole antenna has a simple structure, and low cost, and it can introduce a high roll-off band edge filtering effect while increasing the bandwidth by parasitizing new slot structures on the radiator;

(2) The filtering antenna has good radiation characteristics in the passband, and a band-pass filtering effect with high roll-off and good out-of-band suppression capability outside the passband. The way to achieve the filtering performance does not bring additional processing costs and has wide applications and no additional insertion loss is introduced;

(3) The filtering antenna unit has the characteristics of low profile, wide operating bandwidth, and high gain, and the pattern lobe is stable in the passband, the cross polarization is low, and the feeding structure of different polarization ports is almost completely symmetrical and relatively highly isolated.

DETAILED DESCRIPTION

The present invention will be further described in detail below with reference to the embodiments and the accompanying drawings, but the embodiments of the present invention are not limiting.

EMBODIMENTS

Figure 1:
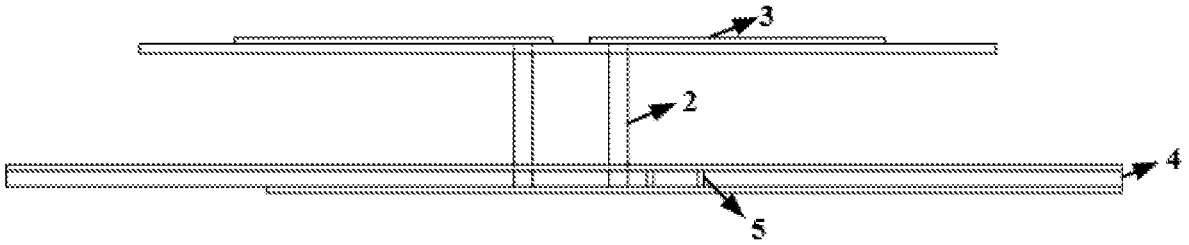
FIG. 1 is a side view of an antenna structure of the present invention.

As shown in FIG. 1, a low-profile dual-polarized filtering magneto-electric dipole antenna comprises two layers of an upper dielectric substrate and a lower dielectric substrate spaced a certain distance apart. The upper surface of the upper dielectric substrate is printed with a radiator structure. The slot coupling feed network is printed on the lower dielectric substrate. The slot coupling feed network with fused filtering function is used to excite the radiator structure with low profile and highly selective filtering response, resulting in good broadband radiation characteristics and high roll-off band-pass filtering effect.

Figure 2:
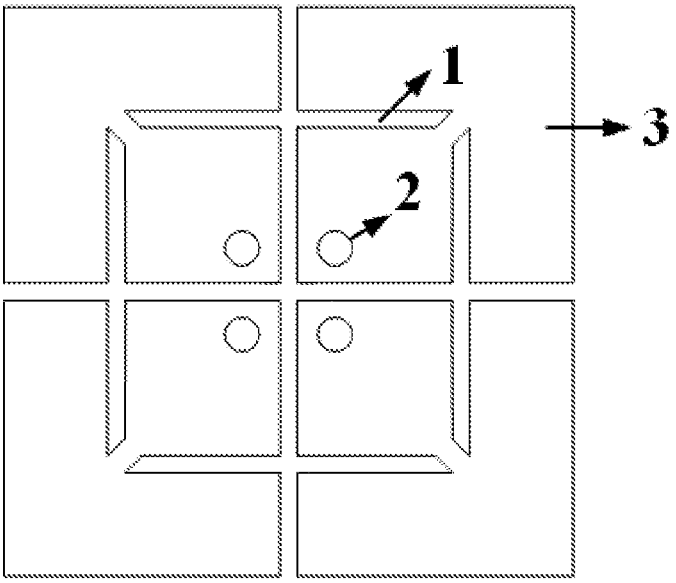
FIG. 2 is a structural diagram of a radiator of the present invention.

As shown in FIG. 2, the radiator structure comprises four parasitic patches 3 loaded with symmetrical slots 1 and short-circuit probes 2. The four parasitic patches constitute a rectangular structure. The symmetrical slots in this embodiment on each parasitic patch have two slots symmetrical about the diagonal of the parasitic patches. The parasitic patches are rectangular. A short-circuit probe is set at one corner of a parasitic patch to form a new type of a low-profile dual-polarized filtering magneto-electric dipole antenna. The four short-circuit probes in this embodiment are all disposed at a corner near the center point of the upper dielectric substrate. The parasitic patches are connected to the metal floor 4 through short-circuit probes.

Magneto-electric dipole working mode is formed by combining magnetic dipole mode formed by the radiation apertures of the gap between the short-circuit patches and electric dipole mode of the patches. Its height, compared with traditional magneto-electric dipole antenna, can be greatly reduced, and by etching the symmetrical slot structure on the metal patches, additional resonance mode is introduced to offset the deterioration of impedance matching caused by reduction of the antenna height, and a radiation suppression null is introduced on the right side of the passband to improve the passband edge frequency selectivity and out-of-band rejection.

Figure 4A:
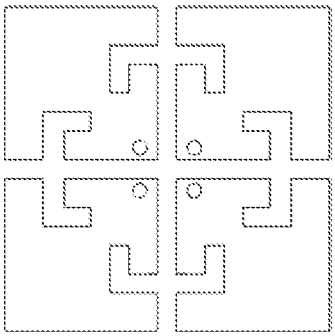
FIGS. 4 (*a*) and 4 (*b*) are structural diagrams of symmetrical slots of the present invention.
Figure 4B:
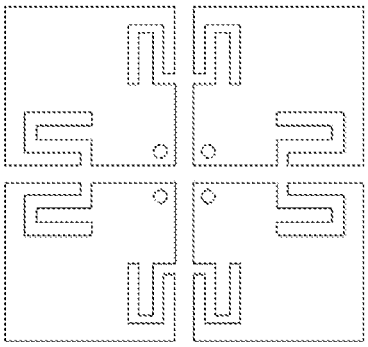

As shown in FIGS. 4 (*a*) and 4 (*b*) are sample cases of other different defective shape structures loaded on the parasitic patches according to the present invention.

Symmetrical slots can be of other symmetrical shapes, including hollowing out different geometric shapes in the middle of the patch and cutting four slots of a certain length along the four perimeters, which can improve the frequency selectivity of the upper edge of the passband.

Figure 3:
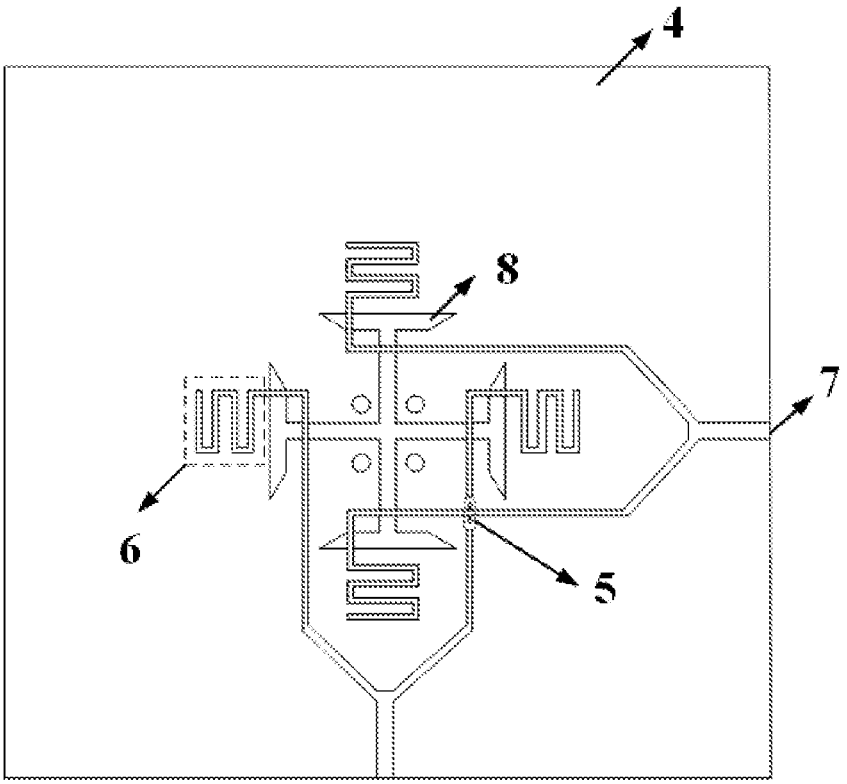
FIG. 3 is a structural diagram of a slot coupling feed network of the present invention.

As shown in FIG. 3, the slot coupling feed network structure comprises two sets of orthogonal Y-shaped feed lines and cross-shaped slots 8, the cross-shaped slots are printed on a metal floor, and the metal floor and the Y-shaped feed lines are printed on different surfaces of the underlying dielectric substrate. In this embodiment, the metal floor is on the upper surface of the lower dielectric substrate, and a cross-shaped slot is printed on the metal floor. The cross-shaped slot is symmetrical about the center point of the lower dielectric substrate, and the Y-shaped feed lines are printed on the lower surface of the lower dielectric substrate.

Of the two sets of orthogonal Y-shaped feed lines, one set of Y-shaped feed line is located at one side of the lower dielectric substrate, and the other set of Y-shaped feed line is located at one end of the lower dielectric substrate. In this embodiment, one set of Y-shaped feed line is located at the left side of the lower dielectric substrate, and one is located is located on the lower end of the lower dielectric substrate. The Y-shaped feeder comprises a one-to-two power divider. Two output ends of one one-to-two power divider are connected to two microstrip lines, and the two microstrip lines is straight and passes through a cross-shaped slot to extend to a certain length, and the extended portion is bent for miniaturization. The two microstrip lines of the one-to-two power divider at one end pass straight through the transverse slot of the cross-shaped slot, and the other two microstrip lines pass straight through the longitudinal slot of the cross-shaped slot. The four extensions of the two one-to-two power dividers have the same length and the same bending process. It couples the parasitic patches on the upper substrate through the cross-shaped slot in the middle of the upper layer, and can introduce a radiation suppression null, and the specific length of the extension of the microstrip after passing the slot is equivalent to half wavelength of the frequency of the radiation suppression null. The principle of its filtering effect is as follows:

The length of the end of the conventional slot coupling microstrip line is only used to adjust the impedance matching of the antenna. In this embodiment, the end of the microstrip line is extended. Because the end of the microstrip line is in an open circuit state, it is still equivalent to an open circuit state after an equivalent half wavelength to the feeding gap, and the amplitude of the input current is zero, so energy cannot be coupled from the transmission line to the patch above the gap. At this frequency, a transmission zero with high suppression will be generated. By adjusting the length of the extended end of the microstrip line, the position of the radiation suppression null can be adjusted to the lower edge of the passband to achieve the high-pass filtering characteristic of wide stopband high roll-off. Combined with the high-pass filtering characteristics of the extended feed microstrip line and the low-pass filtering characteristics of the parasitic patches loaded with the slot structure, the antenna finally achieves a good band-pass filtering performance.

As shown in FIG. 3, the extended microstrip line 6 is located under the metal floor loaded with the cross-shaped slot 8, and the energy is fed to the upper patch by the coupling effect with the slot. The length of the extended portion of the microstrip line after passing through the slot is an equivalent half wavelength of the frequency position of the radiation suppression null.

As shown in FIG. 3, an air bridge 5 formed by using two through holes and strip lines prevents two orthogonal feeding networks from crossing.

Figure 5:
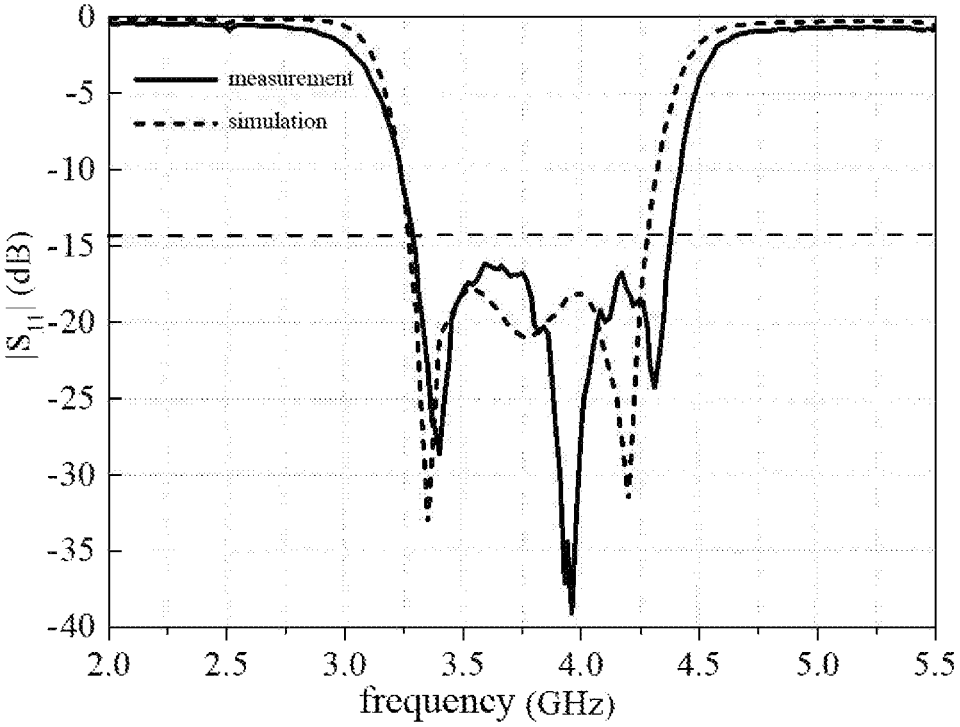
FIG. 5 is a result graph of reflection coefficient S11 versus frequency of the present invention working in simulation and measurement state.
Figure 6:
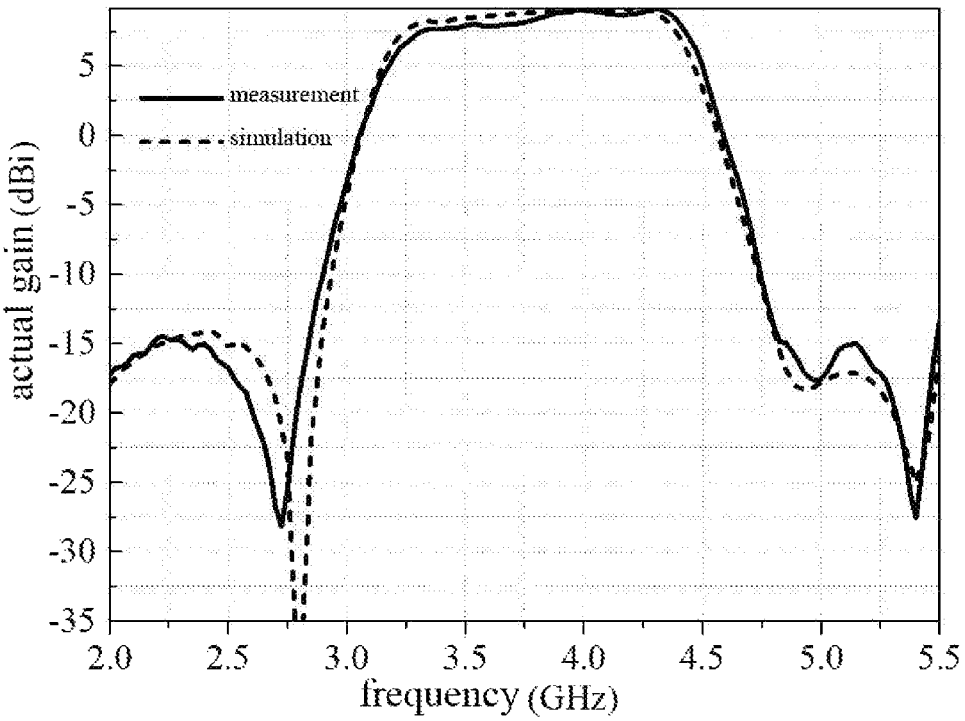
FIG. 6 is a result graph of actual gain versus frequency of the present invention working in a simulation and measurement state.

As shown in FIGS. 5 to 6 are simulation and measurement results of the reflection coefficient S11 versus frequency and gain curve versus frequency of the dual-polarized filtering dipole antenna provided by an embodiment of the present invention. Impedance matching in the passband is good. The impedance bandwidth is 3.3 to 4.36 GHz, and the return loss is below −15 dB; the gain in the working frequency band is about 8.2 dBi, the two sides of the passband have high roll-off filtering characteristics, and the filtering suppression from 0 to 3 GHz of more than 20 dB and out-of-band filtering suppression from 4.7 to 5.5 GHz of more than 25 dB are achieved.

Figure 7:
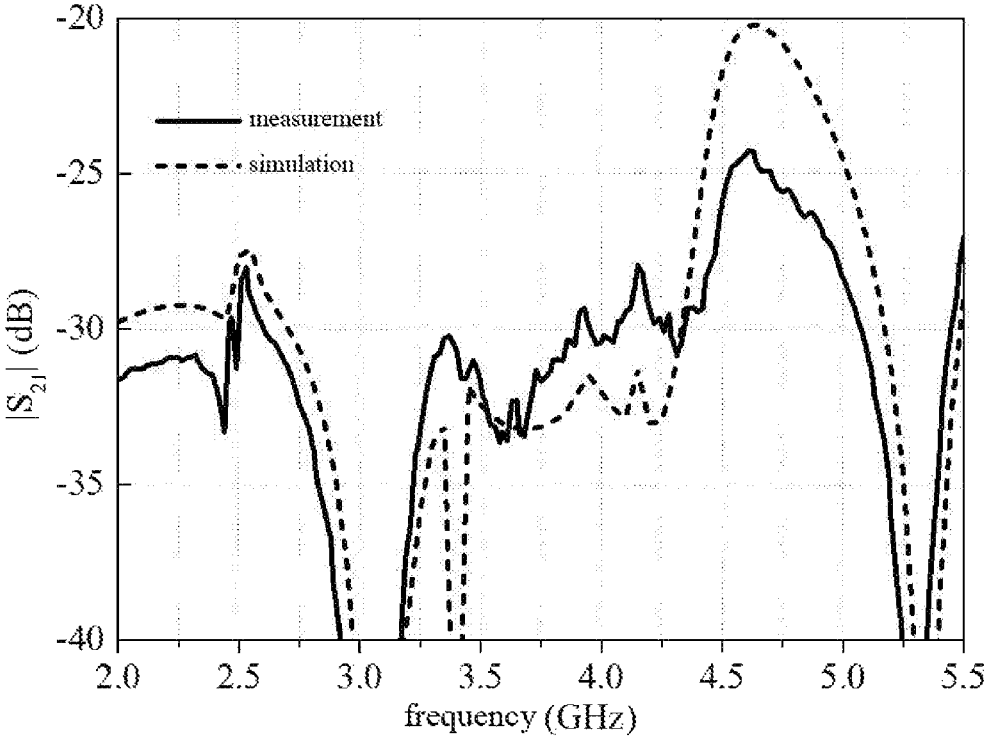
FIG. 7 is a result diagram of the transmission coefficient S21 versus frequency of the present invention working in a simulation and measurement state.

As shown in FIG. 7 are simulation and measurement results of the transmission coefficient S21 versus frequency of the dual-polarized filtering dipole antenna provided by an embodiment of the present invention. The two ports in the passband have better isolation, both below −25 dB.

The embodiments of the present invention have the following advantages:

(1) The dipole antenna has a simple structure and low cost, and it can introduce a high roll-off band edge filtering effect while increasing the bandwidth by parasitizing a new slot structure on the radiator;

(2) The filtering antenna unit has good radiation performance in the passband, and a band-pass filtering effect with high roll-off and good out-of-band suppression capability outside the passband. The way to achieve the filtering performance does not bring additional processing costs and has wide applicable, and no additional insertion loss is introduced;

(3) The filtering antenna unit has the special characteristics of low profile, wide operating bandwidth, and high gain, and the pattern lobe is stable in the passband, the cross polarization is low, and the feed structure of different polarization ports is almost completely symmetrical and highly isolated.

In the embodiment provided by the present invention, the size of the related structure can be adjusted according to requirements to receive and transmit equipment of wireless communication systems of different frequency bands. Due to the filtering characteristics of the present invention, it is particularly suitable for use in open and complex communication scenarios. At the same time, it benefits from the integration of filtering characteristics and radiation characteristics. The present invention is also applicable to single body integration and collective integration of wireless mobile communication system equipment.

The above embodiment is a preferred embodiment of the present invention, but the embodiment of the present invention is not limited by the above embodiment. Any other changes, modifications, substitutions, combinations, and simplifications made that does not depart from the spirit and principle of the present invention shall all be equivalent replacements, all of which are comprised in the protection scope of the present invention.

The invention claimed is:

1. A low-profile dual-polarized filtering magneto-electric dipole antenna, characterized in that, comprising an upper dielectric substrate and a lower dielectric substrate, a radiator structure is printed on an upper surface of the upper dielectric substrate, and a slot coupling feed network structure is printed on the lower dielectric substrate;

the radiator structure comprises four parasitic patches loaded with symmetrical slots, and the parasitic patches are loaded with short-circuit probes;

the slot coupling feed network structure comprises two orthogonal sets of Y-shaped feed lines and cross-shaped slots, the cross-shaped slots are printed on a metal floor, the metal floor and the Y-shaped feed lines are printed on a different surface of the lower dielectric substrate, the parasitic patches are connected to the metal floor through the short-circuit probes.

2. The low-profile dual-polarization filtering magneto-electric dipole antenna according to claim 1, characterized in that, each Y-shaped feed lines comprises a one-to-two power divider, and an output end of the one-to-two power divider is connected to two microstrip lines, the two microstrip lines extend after passing the cross-shaped slots, and the extended portion is bent, and coupled with the parasitic patch of the upper dielectric substrate through the cross-shaped slots to introduce a radiation suppression null.

3. The low-profile dual-polarized filtering magneto-electric dipole antenna according to claim 2, characterized in that, a length of the extended portion is half an equivalent wavelength of a frequency at the frequency of the radiation suppression null.

4. The low-profile dual-polarization filtering magneto-electric dipole antenna according to claim 1, characterized in that, the symmetrical slots comprise symmetrical rectangular slots with respect to a diagonal of the parasitic patches.

5. The low-profile dual-polarized filtering magneto-electric dipole antenna according to claim 1, characterized in that, further comprising two through-holes and an air bridge formed by a strip line, arranged at an intersecting position of the two sets of Y-shaped feed lines.

* * * * *